US007370683B2

(12) United States Patent
Numajiri

(10) Patent No.: US 7,370,683 B2
(45) Date of Patent: May 13, 2008

(54) LIFTING-CORD WINDING MECHANISM OF SOLAR-RADIATION SHIELDING DEVICE

(75) Inventor: Satoshi Numajiri, Tokyo (JP)

(73) Assignee: Toso Company, Limited, Tokyo (JP)

( * ) Notice: Subject to any disclaimer, the term of this patent is extended or adjusted under 35 U.S.C. 154(b) by 308 days.

(21) Appl. No.: 10/528,189

(22) PCT Filed: Sep. 26, 2003

(86) PCT No.: PCT/JP03/12300

§ 371 (c)(1),
(2), (4) Date: Mar. 17, 2005

(87) PCT Pub. No.: WO2004/031523

PCT Pub. Date: Apr. 15, 2004

(65) Prior Publication Data

US 2006/0000564 A1 Jan. 5, 2006

(30) Foreign Application Priority Data

Sep. 30, 2002 (JP) ..... 2002-285239

(51) Int. Cl.
*E06B 9/322* (2006.01)

(52) U.S. Cl. ..... 160/170

(58) Field of Classification Search ..... 160/170, 160/171, 168.1 R, 173 R, 178.1 R, 84.01, 160/84.04, 84.05
See application file for complete search history.

(56) References Cited

U.S. PATENT DOCUMENTS 4,623,012 A * 11/1986 Rude et al. ..... 160/243

(Continued)

FOREIGN PATENT DOCUMENTS

| | | | |
|---|---|---|---|
| EP | 0355244 | * | 2/1990 |
| JP | 3-286091 | A | 12/1991 |
| JP | 5-248156 | A | 9/1993 |
| JP | 11-187969 | A | 7/1999 |
| JP | 11-206552 | A | 8/1999 |

OTHER PUBLICATIONS

Microfilm of the specification and drawings annexed to the request of Japanese Utility Model Aplication No. 106535/1986 (Laid-open No. 12596/1988) (Sasaki Blind Kogyo Kabushiki Kaisha), Jan. 27, 1988.

(Continued)

*Primary Examiner*—Blair M. Johnson
(74) *Attorney, Agent, or Firm*—Birch, Stewart, Kolasch & Birch, LLP

(57) ABSTRACT

A lifting cable winding mechanism of a solar radiation shielding device capable of uniformly winding lifting cables for lifting solar radiation shielding materials on the peripheral surfaces of winding drums and minimizing the extra lengths of the lifting cables remaining in a head rail when the solar radiation shielding materials are lowered to a lower limit, wherein a case (2) is fixed in the head rail (1), the winding drums (4) are fitted to a drive shaft (3) axially passed through the inside of the head rail (1) so as to be rotated integrally with each other, slits (6) are provided at the bottom part of the case (2), rings (7) are fitted to the winding drums (4) so as to be rotated integrally with each other and slidably moved in axial direction, guides (11) suspended from the bottom part openings (10) of the head rail (1) are formed at one end parts of the case (2), and the tips of the lifting cables (5) inserted from the slits (6) into the case (2) through the guide (11) are fixed to the rings (7).

7 Claims, 8 Drawing Sheets

U.S. PATENT DOCUMENTS

| | | | | |
|---|---|---|---|---|
| 4,955,421 | A * | 9/1990 | Torti | 160/243 |
| 5,228,491 | A * | 7/1993 | Rude et al. | 160/171 |
| 5,908,062 | A * | 6/1999 | Fun | 160/170 |
| 6,915,831 | B2 * | 7/2005 | Anderson | 160/173 R |
| 7,178,577 | B2 * | 2/2007 | Liu | 160/170 |
| 7,210,646 | B2 * | 5/2007 | Hsu | 242/397 |
| 2007/0144685 | A1 * | 6/2007 | Chigusa | 160/170 |

OTHER PUBLICATIONS

CD-ROM of the specification and drawings annexed to the request of Japanese Utility Model Aplication No. 65414/1992 (Laid-open No. 20887/1994) (SM Kogyo), Mar. 18, 1994.

Micorfilm of the specification and drawings annexed to the request of Japanese Utility Model Application No. 33269/1989 (Laid-open No. 124090/1990) (Toso Co., Ltd.), Oct. 12, 1990.

CD-ROM of the specification and drawings annexed to the request of Japanese Utility Application No. 35632/1993 (laid-open No. 1286/1995) ( Kabushiki Kaisha Nicchu Seisakusho), Jan. 10, 1995.

Microfilm of the specification and drawings annexed to the request of Japanese Utility Model Application No. 67162/1987 (Laid-open No. 173498/1988) (Nichibei Kabushiki Kaisha), Nov. 10, 1988.

Microfilm of the specification and drawings annexed to the request of Japanese Utility Application No. 130741/1982 (Laid-open No. 21884/1984) (Tachikawa Blind MFG Co Ltd), Feb. 3, 1984.

* cited by examiner

Fig. 8
(a)
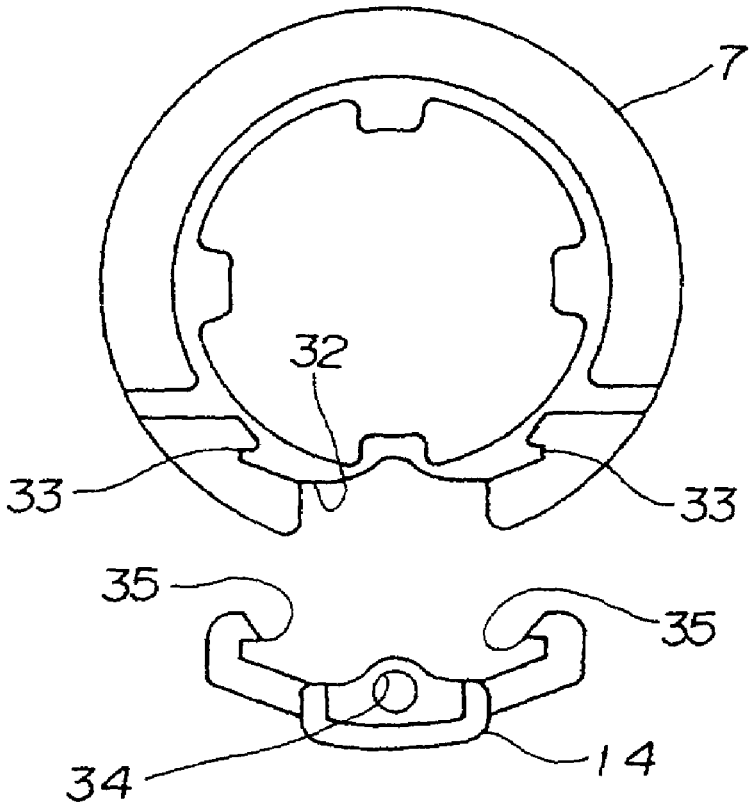
(b)
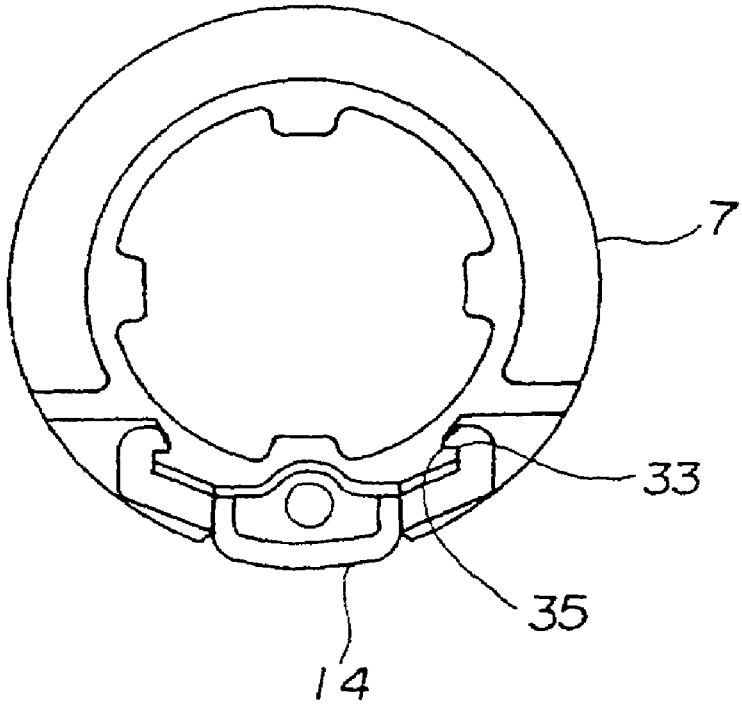

LIFTING-CORD WINDING MECHANISM OF SOLAR-RADIATION SHIELDING DEVICE

TECHNICAL FIELD

The present invention relates to a lifting-cord winding mechanism used for a solar-radiation shielding device, such as interior blinds, pleated screens, and roman shades.

BACKGROUND TECHNOLOGY

Conventionally, a solar-radiation shielding device lifts and lowers a single solar-radiation shielding member by means of a plurality of lifting-cord winding mechanisms. The lifting-cord winding mechanism winds, around a winding drum, a lifting-cord that lifts and lowers the solar-radiation shielding member, where the winding drum is fitted to a drive shaft so that the winding drum is rotatable integrally with a drive shaft disposed in a head rail along the axial direction of the head rail. With the drive shaft rotating in one direction, the lifting-cord is wound onto the winding drum, which lifts the solar-radiation shielding member. With the drive shaft rotating in the opposite direction, the lifting-cord is reeled out of the winding drum, which lowers the solar-radiation shielding member.

According to a lifting-cord winding mechanism disclosed in Japanese Patent Publication Gazette No. 05-248156, the mechanism functions such that a lifting-cord is inserted through an entrance hole of a case fixed to a head rail having a bottom opening, with the tip of the lifting-cord fixed to a driving shaft directly or via a ring, and a winding drum is formed so as to have a larger diameter on one side thereof where the entrance hole is located, thereby preventing the lifting-cord from unaligned winding and partially overlapped winding. Since this prior art example enables the lifting-cord, wound around the external circumferential surface of the winding drum, to be wound uniformly, the solar-radiation shielding member is not likely to be lowered unevenly even when a plurality of lifting-cord winding mechanisms are used. This example however has a problem in that, since the position where the tip of the lifting-cord is attached on the winding drum is distant from the entrance hole, much surplus length of the lifting-cord remains in the head rail when the solar-radiation shielding member is lowered to a lower limit, thereby increasing the cost.

According to a lifting-cord winding mechanism disclosed in Japanese Patent Publication Gazette No. 11-206552, the mechanism functions such that a lifting-cord is inserted through a slit on the bottom of a case fixed to a head rail, with the tip of the lifting-cord attached to a ring fitted around a winding drum so that the ring is rotatable integrally with the winding drum but is slidable axially along the winding drum, and the ring is pushed along by the lifting-cord wound around the winding drum, thereby causing the wound lifting-cord to be well aligned on the circumferential surface of the winding drum. Little surplus length of the lifting-cord remains in the head rail when the solar-radiation shielding member is lowered to a lower limit. This example however has a problem in that, the lifting-cord, wound around the external circumferential surface of the winding drum, is likely to cause unaligned winding and partially overlapped winding, and is unable to be wound uniformly, whereby the solar-radiation shielding member is likely to be lowered unevenly when a plurality of lifting-cord winding mechanisms are used, thereby deteriorating the functionality and designing of the lifting-cord winding device.

Furthermore, with both the prior art examples, the winding drum restricts the hanging position of the lifting-cord, whereby the lifting-cord is unable to hang at an arbitrary position.

The present invention is made to solve the problems described above. Thus, an object of the present invention is to provide a lifting-cord winding mechanism of a solar-radiation shielding device wherein a lifting-cord for lifting a solar-radiation shielding member is enabled to be uniformly wound around a winding drum, the surplus length of the lifting-cord is made minimum that remains in a head rail when the solar-radiation shielding member is lowered to a lower limit, and the lifting-cord is enable to hang at an arbitrary position.

DISCLOSURE OF THE INVENTION

To accomplish the object described above, a first means provided, according to the present invention, is a lifting-cord winding mechanism of a solar-radiation shielding device such that a case is fixed in a head rail, a winding drum is fitted around the drive shaft disposed in the head rail along the axial direction of the head rail so that the winding drum is rotatable integrally with the drive shaft, a slit is disposed at the bottom part of the case for a lifting-cord to pass through, a ring is fitted around the winding drum so that the ring is rotatable integrally with the winding drum but is slidable axially along the winding drum, and the lifting-cord is inserted into the case through the slit with the tip thereof attached to the ring, wherein a guide is formed at a bottom opening of the head rail and the lifting-cord enters into the case via the guide from outside of the head rail. Preferably, the guide is disposed to be integral with one end portion of the case and to hang from the bottom opening of the head rail. However, the guide may be removably disposed to either the head rail or case. Preferably, the guide has a roller having the axis center thereof adjustably positioned where the lifting-cord is adapted to pass through the roller. Instead of a guide of this type, however, a guide may be of a type having a guide hole for the lifting-cord to pass. This means provides the lifting-cord, during the winding-up motion, with an appropriate amount of tension, whereby the unaligned winding of the lifting-cord around the winding drum due to looseness is prevented from occurring. Since the ring, where the tip of the lifting-cord is attached to, is located near the guide, the surplus length of the lifting-cord remaining in the head rail is very little, when the solar-radiation shielding member is lowered to the lower limit.

A second means provided is such that the winding drum is formed in a circular-cone shape at one end portion thereof with the larger-diameter end of the circular-cone shape disposed at the one end, and is formed in either another circular-cone or a cylindrical shape at a portion thereof continuing to the one end portion thereof; the another circular-cone shape has a conical angle that is the same as or smaller than the conical angle of the circular-cone shape formed at the one end portion thereof. According to the second means, furthermore, a sidewall bearing one end portion of the winding drum is adopted to have an inclined surface formed on the internal surface thereof, the inclined surface diagonally extending toward the lower end thereof along the lifting-cord. According to the second means, the inclined surface aligns the newly wound portion of the lifting-cord together and sequentially sends out such portion toward the other end side of the winding drum, where the one end portion of the winding drum having the larger-diameter end of the circular-cone shape causes the previously wound lifting-cord together with the ring to move toward the other end side of the winding drum. Thus, the lifting-cord is wound around the winding drum orderly, thereby preventing partial overlap winding from occurring.

A third means provided is such that the lifting-cord has the tip thereof attached to a knob, where the knob is removably fixed to the ring. A recess may be formed on the external circumferential surface of the ring for the knob to be fitted in, where the knob is elastically fitted in the recess. Then, the action of attach-remove to the ring, of the knob where the tip of the lifting-cord is attached to, becomes simple and the maintenance of the lifting-cord is made easy.

A fourth means provided is such that the lifting-cord adapted to hang at a position spaced away from the guide, is guided via a center guide. According to the fourth means, the lifting-cord adapted to hang at a position spaced away from the guide first passes through the guide, then through a center guide fixed to the head rail, to hang at the adapted position. Thus, the lifting-cord is enabled to hang at a desired position wherever the lifting-cord winding mechanism is located in the head rail.

As mentioned above, the lifting-cord winding mechanism of a solar-radiation shielding device, according to the present invention, is such that: a winding drum is fitted around a drive shaft disposed in a head rail along the axial direction of the head rail so that the winding drum is rotatable integrally with the drive shaft; sidewalls that define the axial position of the winding drum and bear the winding drum at both ends thereof are disposed at both ends of the case fixed to the hand rail; a slit is provided at the bottom of the case; a ring is fitted around the winding drum so that the ring is rotatable integrally with the winding drum but is slidable axially along the winding drum; the winding drum is formed in a circular-cone shape at one end portion thereof with the larger-diameter end of the circular-cone shape disposed at the one end, and is further formed in either another circular-cone or a cylindrical shape at a portion thereof continuing to the one end portion thereof, the another circular-cone shape has a conical angle that is the same as or smaller than the conical angle of the circular-cone shape formed at the one end portion thereof; a sidewall surrounding the one end portion of the winding drum has an inclined surface formed on the internal surface thereof, the inclined surface diagonally extending toward the lower end thereof along the lifting-cord; a knob with the tip of the lifting-cord attached to is elastically removably fixed to the ring; and a guide leading the lifting-cord is disposed on the case or the head rail. Thus, excellent effects as mentioned below are shown.

1. Since the surplus length of the lifting-cord remaining in the head rail is very little when the solar-radiation shielding member is lowered to the lower limit, the cost of the lifting-cord is reduced.

2. Since the lifting-cord is wound around the winding drum orderly, the solar-radiation shielding member is not likely to be lowered unevenly even when a plurality of lifting-cord winding mechanisms are used, the functionality and designing of the lifting-cord winding device are improved.

3. Since a plurality of winding cables for the lift-lower action of the solar-radiation shielding member are enabled to hang at optimal positions, the operability of the lifting-cord winding device is improved.

4. Attaching the tip of the lifting-cord to the lifting-cord winding mechanism is made easy.

BRIEF DESCRIPTION OF THE DRAWINGS

FIG. 8 are assembled and disassembled views showing a combination of a ring and a knob of FIG. 2, where (a) shows a disassembled status and (b) an assembled status;

FIG. 10 is a view showing reeling of the lifting-cord of still another embodiment;

BEST EMBODIMENTS OF THE INVENTION

Figure 1:
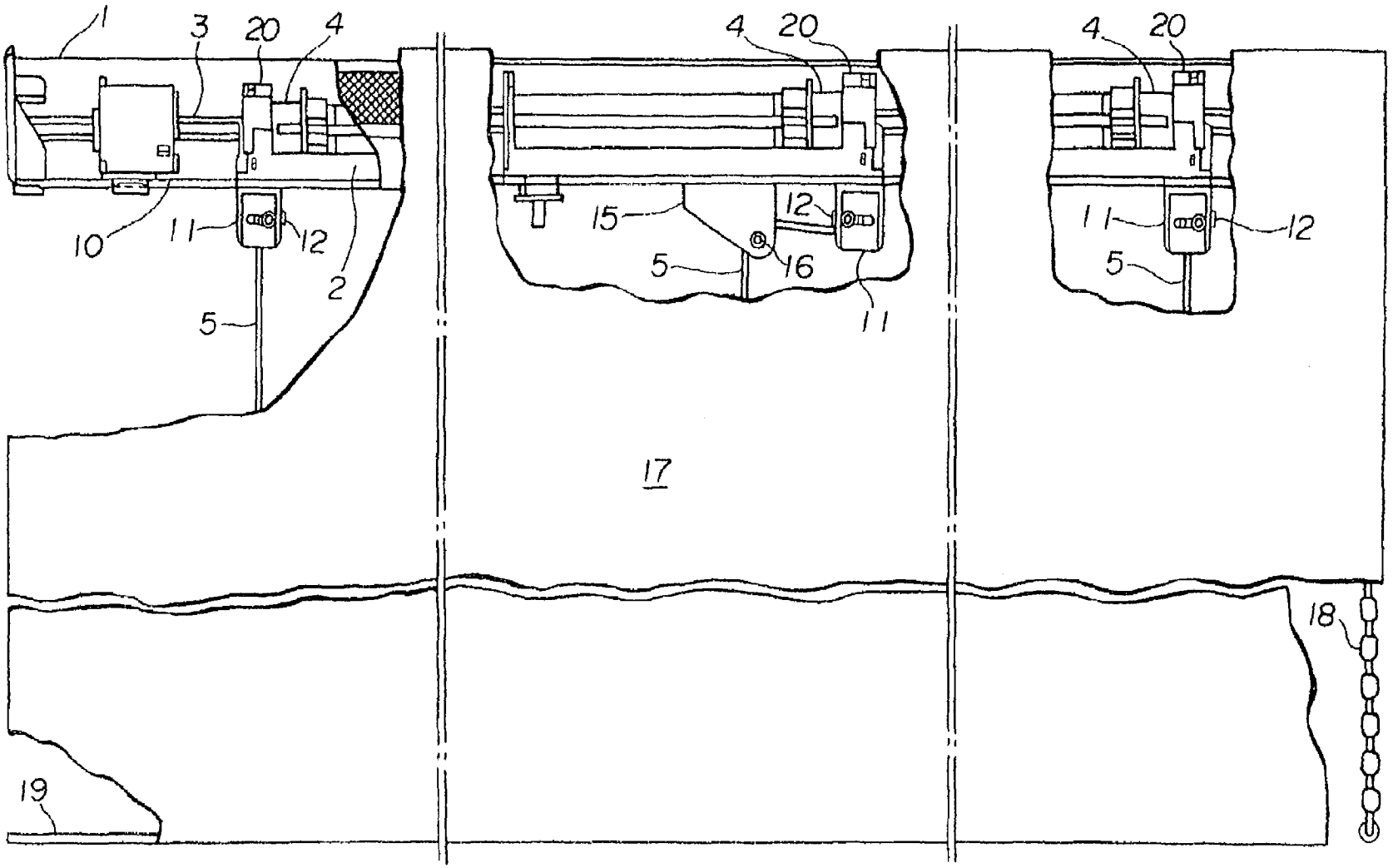
FIG. 1 is an elevational partially broken view of a major part of a roman shade screen having a lifting-cord winding mechanism according to an embodiment of the present invention.

The present invention will be explained, based on embodiments shown in the drawings. FIG. 1 shows an elevational partially broken view of a major part of a roman shade screen having a lifting-cord winding mechanism, according to an embodiment of the present invention. FIGS. 2, 3, 4 and 5 are an elevational partially broken view, a longitudinal sectional view, a left side view and a right side view of the lifting-cord winding mechanism of FIG. 1.

The roman shade screen shown in FIG. 1 is equipped with lifting-cord winding mechanisms 20 at the center and both side portions of a head rail 1. A case 2 of the lifting-cord winding mechanism is fixed to a bottom opening 10 of the head rail 1. Lifting-cords 5 on the both sides of the roman shade screen hang from guides 11 on one side end portion of the lifting-cord winding mechanisms 20. The lifting-cord winding mechanism 20 at the center has a guide 11 located shifted from the center of the head rail 1 to the right. Because of this, a center guide 15 is fixed to the center of the head rail 1, where the lifting-cord 5 at the center is passed through a roller 12 of the guide 11, thereafter extended horizontally. Then, the lifting-cord 5 is further passed through a roller 16 of the center guide 15, to hang. The lower ends of the three lifting-cords 5 are tied to the lower end of a screen 17. While the guide 11 is formed integral with the case 2, the guide 11 also may be formed separate and removably fixed to the case 2. With a ball chain 18 pulled that hangs from one-side end of the head rail 1, a drive shaft 3 of the lifting-cord winding mechanism 20 rotates, the lifting-cord 5 is wound up around a winding drum 4, and the screen 17 is lifted. Then, with the ball chain 18 released, the screen 17 stops at a position where it stands, by means of a stopper. In case the ball chain 18 is pulled slightly and released, then, the stopper is disengaged, and the screen 17 and a bottom bar 19 are lowered by means of the self-weight thereof. In this case, the drive shaft 3 of the lifting-cord winding mechanism 20 rotates reversely, and the lifting-cord 5 is reeled off the winding drum 4.

Figure 2:
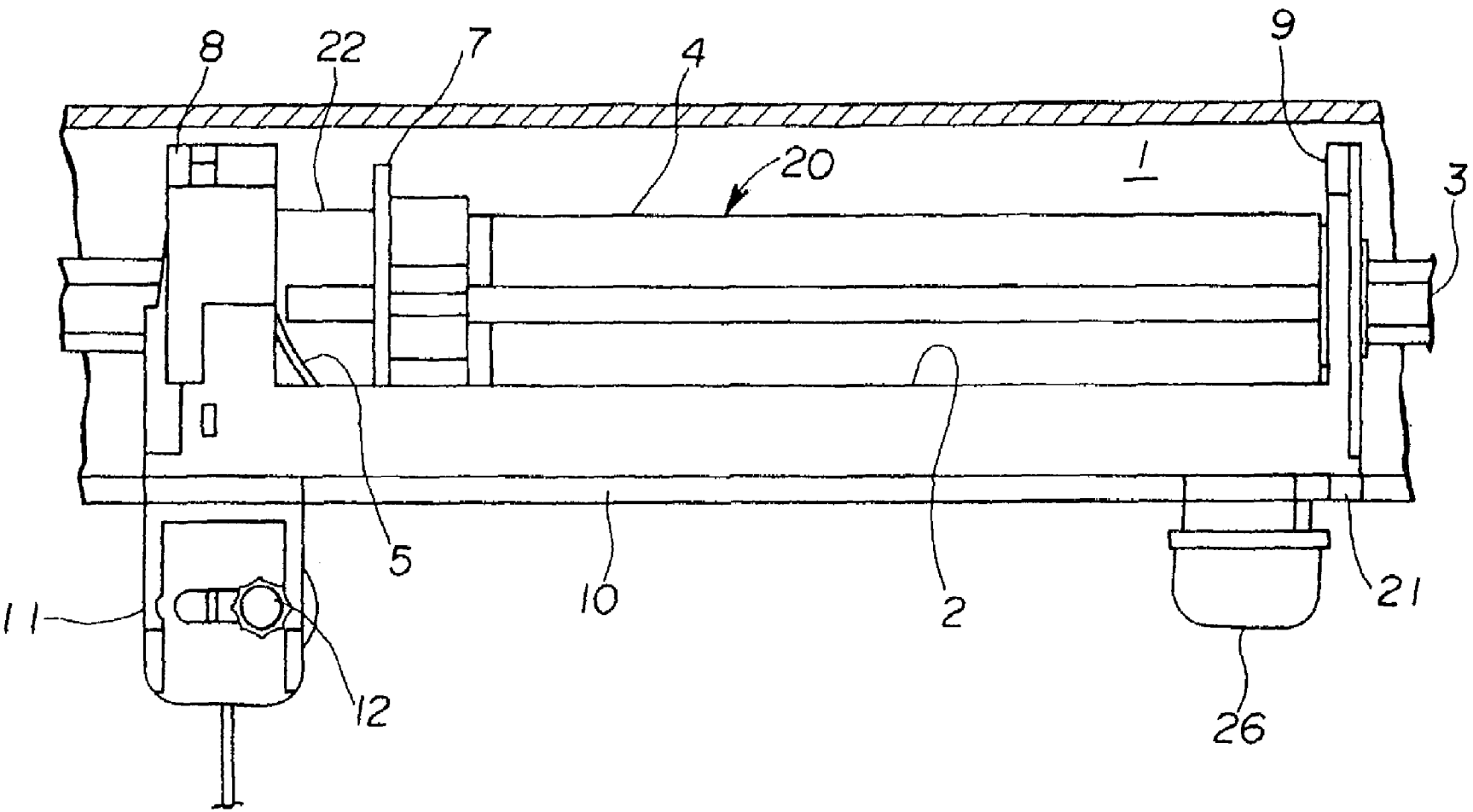
FIG. 2 is an elevational partially broken view of the lifting-cord winding mechanism of FIG. 1.
Figure 3:
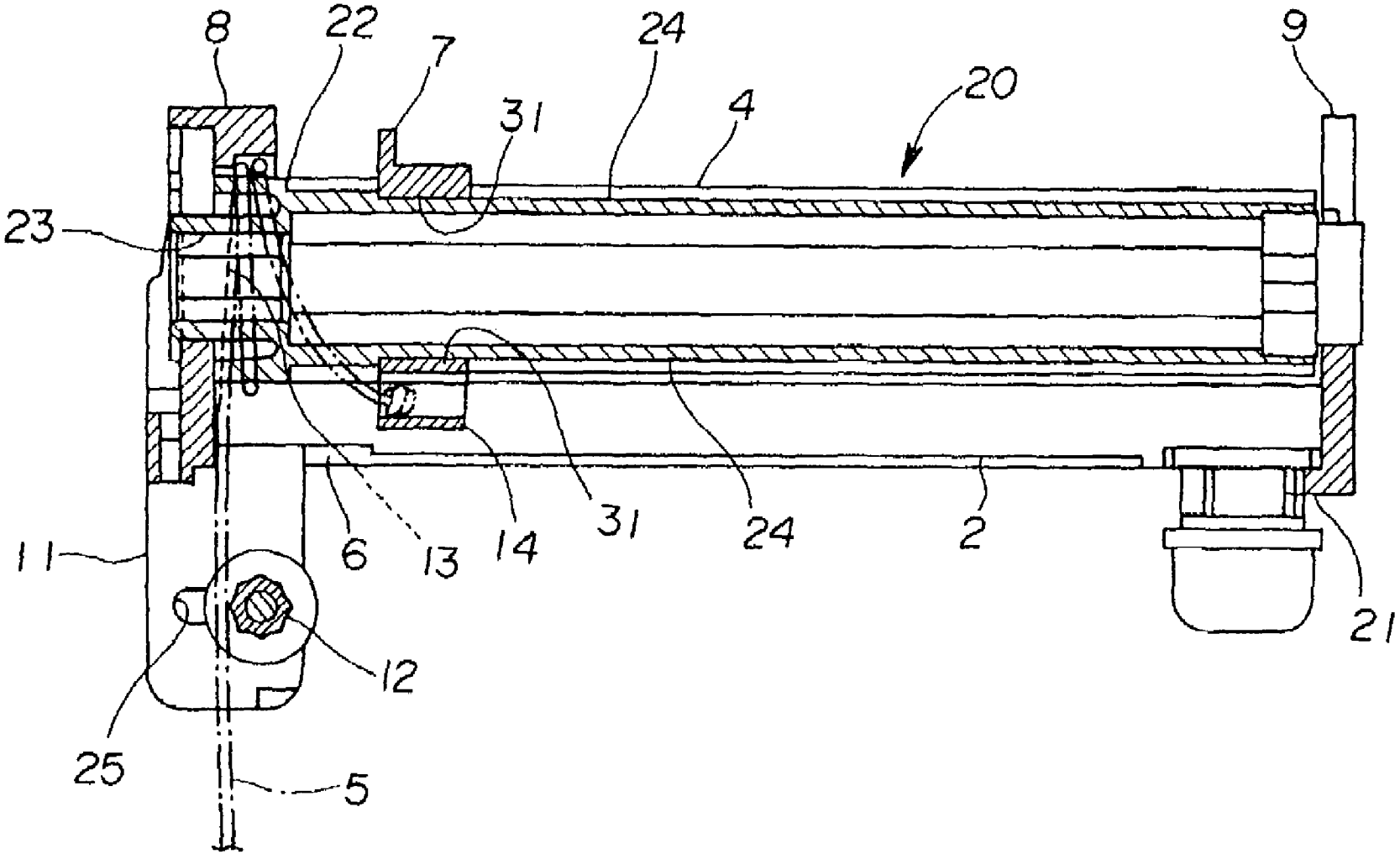
FIG. 3 is a longitudinal sectional view of the lifting-cord winding mechanism of FIG. 2; the FIG. 4 is a left side view of a lifting-cord winding mechanism of FIG. 2.

As shown in FIGS. 2 and 3, the lifting-cord winding mechanism 20 has the case 2 disposed in the head rail 1; the winding drum 4 fitted to the drive shaft 3 disposed in the head rail 1 along the axial direction of the head rail 1, so that the winding drum 4 is rotatable integrally with the drive shaft 3; both sidewalls 8, 9, disposed at both ends of the case 2, that define the axial position of the winding drum 4 and bear the winding drum 4 at both ends thereof, a slit 6 made open at the bottom of the case 2; a ring 7 fitted around the winding drum 4 so that the ring 7 is rotatable integrally with the winding drum 4 but is slidable axially along the winding drum 4; a guide 11, disposed on one end of the case 2, that hangs from the bottom opening 10 of the head rail 1; and a base 21, disposed on the other end of the case 2, that fits the bottom opening 10 of the head rail 1.

Figure 6:
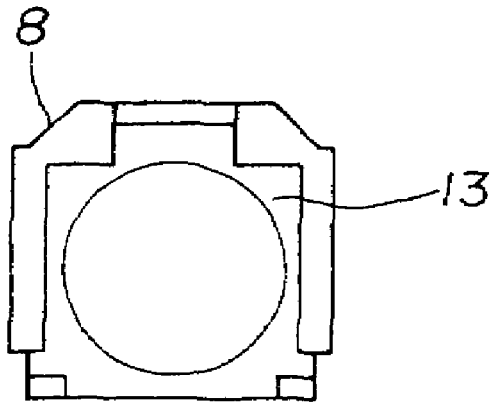
FIG. 6 is a view of one inside-end surface of a sidewall of FIG. 2.

The winding drum 4 has a hexagonal-shaped shaft hole 23 on one end thereof that fits the drive shaft 3 of a hexagonal shape, a round hole on the other end thereof that fits the drive shaft 3 with a play, and four grooves 24 axially extending on the external circumferential surface thereof. The ring 7, fitted around the winding drum 4, rotates integrally with the winding drum 4 but freely slides axially along the winding drum 4. For this, the ring 7 has projections 31 on the internal circumferential surface thereof that fit the grooves 24 of the winding drum 4. One end portion of the winding drum 4 is formed in a circular-cone shape with the larger-diameter disposed at the one end, and a portion continuing to the one end portion of the winding drum 4 is formed in another circular-cone shape having a conical angle smaller than the conical angle of the circular-cone shape formed at the one end portion thereof. As shown in FIGS. 3 and 6, a sidewall 8 of the case 2 surrounding the one end portion 22 of the winding drum 4 has the internal surface thereof made to form an inclined surface 13 diagonally extending toward the lower end thereof. This inclined surface 13 is orthogonal with the one end portion 22 when seen from the front.

The lifting-cord 5 passes along the roller 12 of the guide 11 and through the slit 6 of the case 2. The lifting-cord 5 then passes along the inclined surface 13 of the sidewall 8, is wound along the circumferential surface of the circular-cone shape at the one end portion 22 of the winding drum 4, with a knot on the tip thereof tied to a knob 14 of the ring 7.

Figure 4:
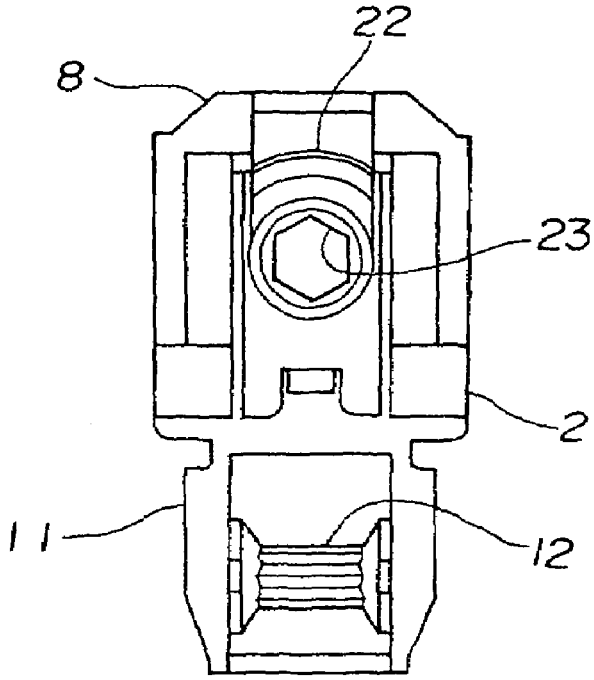

As shown in FIGS. 3 and 4, the guide 11 of the case 2 located under the sidewall 8 is a framework made of front and rear flat plates, where the framework supports the axis of the rotatable roller 12, with the axis position held adjustable, by means of two parallel long holes 25 extending horizontally. The position of the roller 12 may be made slightly adjustable according to the hanging position of the lifting-cord 5.

Figure 5:
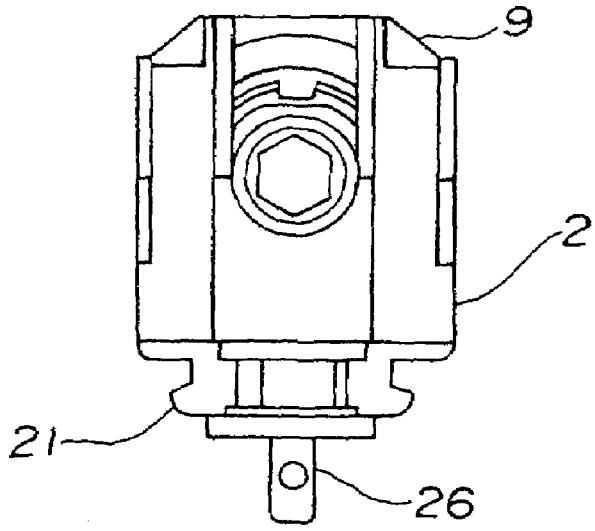
FIG. 5 is a right side view of a lifting-cord winding mechanism of FIG. 2.

As shown in FIGS. 2 and 5, the base 21 of the case 2 located under the sidewall 9 has a closable two-legged shape fitted to the opening 10 at the bottom center of the head rail 1, where the base 21 vertically grips the both side edges of the bottom opening 10 of the head rail 1. A lock 26 is rotatably inserted from under into the center of the base 21. With the lock 26 rotated by 90 degrees, the base opens and the case 2 is elastically fixed to the head rail 1. When the lock 26 is rotated back to the original position, the case 2 is made movable along the bottom opening 10 of the head rail 1.

Figure 7:
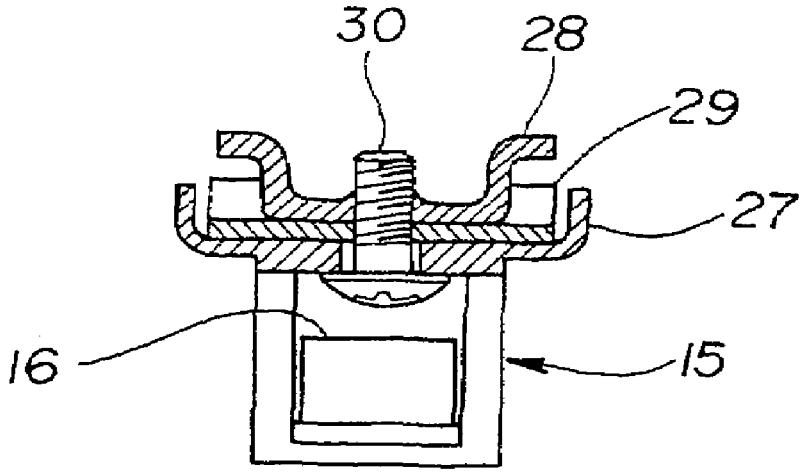
FIG. 7 is a partial sectional side view of a center guide of FIG. 1.

As shown in FIG. 7, the center guide 15, when seen in the longitudinal direction of the head rail, is a U-shaped framework bearing the roller 16 horizontal and rotatably, having a box-shaped fixing seat 27 integrally formed on the top thereof. The center guide 15 is fixed to the head rail by fitting to the box-shaped fixing seat 27 the bottom of a fixing plate 28 having a U-shaped cross section caught on the both side edges of the opening of the head rail, and by driving a fixing screw 30 through a loose hole at the center of the fixing seat 27 into a screw hole of the fixing plate 28. A spacer 29 may be placed between the fixing seat 27 and the fixing plate 28 for stabilized fixing.

As shown in FIG. 8(*a*), a recess 32, that removably fits the knob 14, is disposed on the external circumferential surface of the ring 7. The recess 32 has hook catches 33 formed on the both sides thereof. The knob 14 has a hole 34 formed at the center thereof for attaching the tip of the lifting-cord 5, and has hooks 35 formed on both side ends along the circumferential direction thereof. As shown in FIG. 8(*b*), with the knob 14 fitted to the recess 32 of the ring 7, the hooks 35 and the hook catches 33 are elastically engaged to cause the knob 14 and the ring 7 to be integrally fixed.

When the screen 17 is lowered to a lower limit, the ring 7 that has the tip of the lifting-cord 5 attached thereto, is located near the guide 11, where the surplus length of the lifting-cord 5 remaining in the head rail 1 is short. When the drive shaft 3 is rotated in the direction of the screen 17 being lifted, the roller 12 of the guide 11 provides the lifting-cord 5 with an appropriate amount of tension, whereby it is not likely that the lifting-cord 5 gets loose and causes unaligned winding.

The inclined surface 13 of the sidewall 8 stays along the newly wound portion of the lifting-cord 5, and thereby prevents the wound lifting-cord 5 from unaligned winding. Furthermore, the one end portion 22 of the winding drum 4, having the larger-diameter end of a circular-cone shape disposed thereon, causes the previously wound lifting-cord 5 to move toward the ring, thereby preventing partial overlap winding from occurring. As a result, the lifting-cord is wound around the winding drum 4 orderly, whereby the screen 17 is not likely to be lowered unevenly even when a plurality of lifting-cord winding mechanisms are used. Since the tip of the lifting-cord 5 is attached to the ring 7 by means of knob 14, the attach-remove action of the lifting-cord is made very easy.

Figure 9:
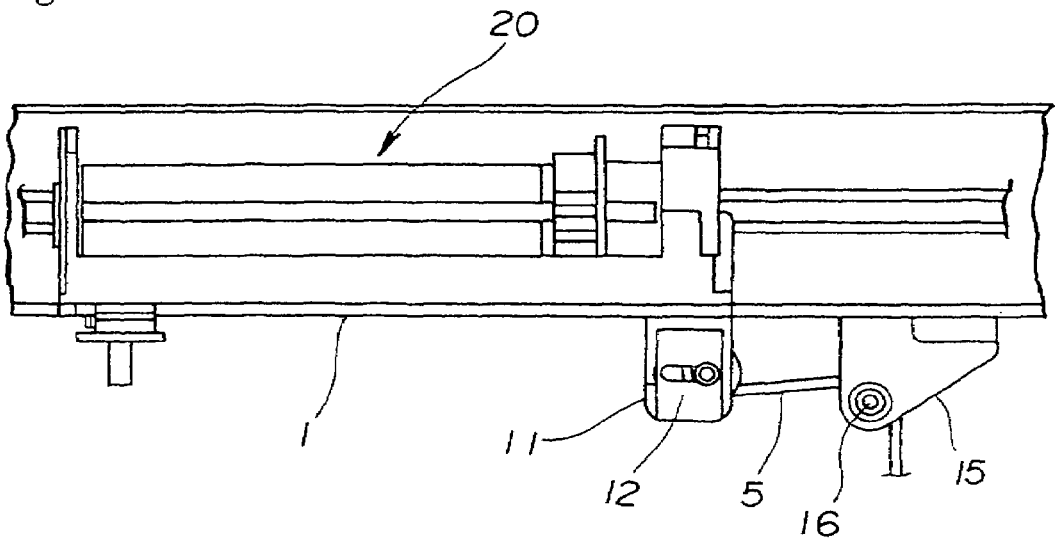
FIG. 9 is a view showing reeling of the lifting-cord of another embodiment.
Figure 1:
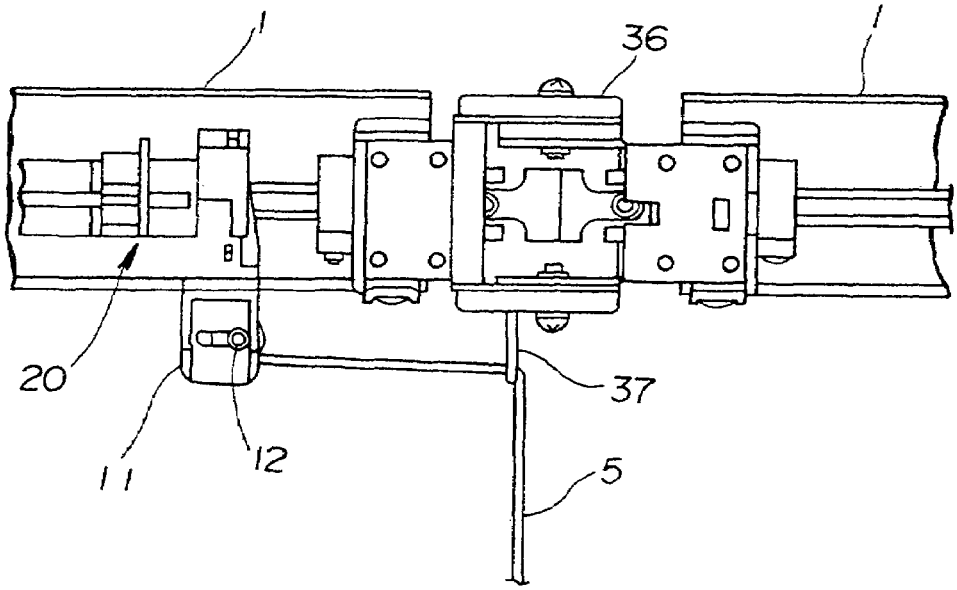

Next, additional embodiments will be explained. FIG. 9 is a roman shade screen of another embodiment showing how a lifting-cord 5 at the center of the roman shade screen is reeled where a guide 11 of a lifting-cord winding mechanism 20 at the center is shifted from the center of the head rail 1 to the left. The lifting-cord 5 is passed through a roller 12 of the guide 11 to the right. Then, the lifting-cord 5 is further passed through a roller 16 of the center guide 15, to hang. The arrangement is the same as that of FIG. 1 except the portion described above.

An embodiment of FIG. 10 is a roman shade screen for use in a corner of still another embodiment showing how a lifting-cord 5 is reeled where two head rails 1 are connected by means of a corner joint 36. The lifting-cord 5, pulled out of a guide 11 of a lifting-cord winding mechanism 20 at the center, is passed through a roller 12 of a guide 11 toward under the corner joint 36, then, passed through a guide 37, to hang. The arrangement is the same as that of FIG. 1 except the portion described above.

Figure 11:
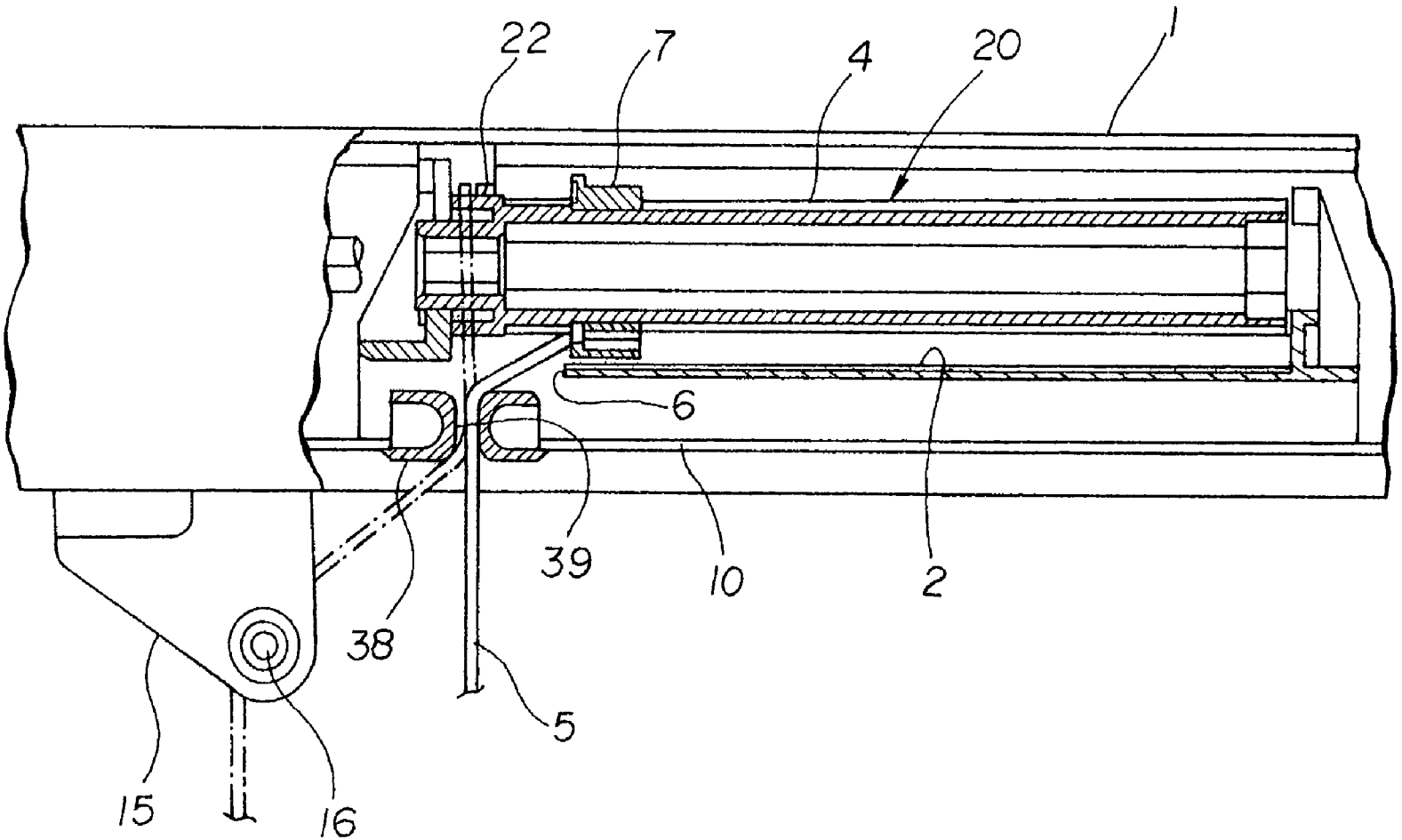
FIG. 11 is a longitudinal sectional view of a lifting-cord winding mechanism of a further embodiment.

An embodiment of FIG. 11 shows a further embodiment where a lifting-cord winding mechanism 20 has a guide 38 removably fixed to a bottom opening 10 of a head rail 1. The upper end of a lifting-cord 5 is tied to a ring 7 on a winding drum 4. The lifting-cord 5 enters a perpendicular guide hole 39 of a guide 38 perpendicularly or diagonally through a roller 16 of a center guide 15. When the screen is lowered to a lower limit, the lifting-cord 5 passes through the perpendicular guide hole 39, extends diagonally and enters into a case 2 through a slit 6. When the lifting-cord 5 is wound around one end portion 22 of a winding drum, the lifting-cord 5 extends perpendicularly from the guide hole 39 of the guide 38 and enters into the case 2 through the slit 6. The arrangement is the same as that of FIG. 1 except the portion described above.

What is claimed is:

1. A lifting-cord winding mechanism of a solar-radiation shielding device having a head rail, a case removably fixed in said head rail, a drive shaft rotatably supported in said head rail, a winding drum fitted around said drive shaft so that said winding drum is rotatable integrally with said drive shaft, a slit disposed at the bottom part of said case, a ring fitted around said winding drum so that said ring is rotatable integrally with said winding drum but is slidable axially along said winding drum, two sidewalls bearing said winding drum at both ends of said case, and a lifting cord inserted into said case through said slit with the tip thereof attached to said ring, said lifting-cord winding mechanism of a solar-radiation shielding device wherein:

a guide is disposed either in said case or said head rail, said lifting-cord entering into said case via said guide, and said winding drum is formed in a circular-cone shape at one end portion thereof with the larger-diameter end of said circular-cone shape disposed at said one end, and is formed in either another circular-cone shape or a cylindrical shape at a portion thereof continuing to said one end portion thereof, said another circular-cone shape having a conical angle that is the same as or smaller than the conical angle of said circular-cone shape formed at said one end portion thereof, and said sidewall surrounding said one end portion of said winding drum has an inclined surface formed on the internal surface thereof, said inclined surface diagonally extending toward outside, and said lifting cord has said tip thereof attached to a knob, said knob removably fixed to said ring.

2. A lifting-cord winding mechanism of a solar-radiation shielding device according to claim 1, wherein:

said guide is formed either integral with, or separate from, one end portion of said case, said guide hanging from a bottom opening of said case.

3. A lifting-cord winding mechanism of a solar-radiation shielding device according to claim 1, wherein:

said guide is removably fixed to a bottom opening of said head rail.

4. A lifting-cord winding mechanism of a solar-radiation shielding device according to claim 2, wherein:

said guide has a rotatable roller having the axis center thereof disposed horizontal, and orthogonal with the longitudinal direction of said head rail, said roller having said axis center thereof adjustably positioned.

5. A lifting-cord winding mechanism of a solar-radiation shielding device according to claim 2, wherein:

said guide has a guide hole disposed therein for said lifting-cord to pass through.

6. A lifting-cord winding mechanism of a solar-radiation shielding device according to claim 4, wherein:

said lifting-cord, adapted to hang at a position spaced away from said guide, first passes through said roller of said guide, then passes through a roller of a center guide fixed to said head rail, to hang at said position.

7. A lifting-cord winding mechanism of a solar-radiation shielding device according to claim 4, wherein:

said lifting-cord coming out through said roller of said guide of a plurality of said head rails connected by means of a corner joint, first passes toward under said corner joint, then passes through a guide of said corner joint, to hang.

* * * * *